US009272837B2

(12) United States Patent
Linzell

(10) Patent No.: US 9,272,837 B2
(45) Date of Patent: Mar. 1, 2016

(54) PAD DISPENSING RUBBING TOOL

(71) Applicant: Ball Burnishing Machine Tools Ltd., Hatfield (GB)

(72) Inventor: Geoffrey Robert Linzell, Hatfield (GB)

( * ) Notice: Subject to any disclaimer, the term of this patent is extended or adjusted under 35 U.S.C. 154(b) by 0 days.

(21) Appl. No.: 13/712,582

(22) Filed: Dec. 12, 2012

(65) Prior Publication Data

US 2013/0313278 A1 Nov. 28, 2013

Related U.S. Application Data

(63) Continuation of application No. 12/302,365, filed as application No. PCT/GB2007/001947 on May 25, 2007, now abandoned.

(30) Foreign Application Priority Data

May 25, 2006 (GB) ..... 0610373.3
Oct. 5, 2006 (GB) ..... 0619635.6
Feb. 6, 2007 (GB) ..... 0702194.2

(51) Int. Cl.
*B65D 83/08* (2006.01)
*A61H 7/00* (2006.01)

(52) U.S. Cl.
CPC ..... *B65D 83/08* (2013.01); *A61H 7/003* (2013.01); *A61H 7/004* (2013.01); *A61H 2201/0153* (2013.01); *A61H 2201/1604* (2013.01); *A61H 2205/022* (2013.01)

(58) Field of Classification Search
CPC ..... A61H 7/003; A61H 2201/0153; A61H 2205/022; A61H 2201/1604; B65D 83/08
USPC ..... 15/104.94, 209.1, 229.11, 229.13, 15/229.14, 231, 232; 401/123, 124, 125, 401/262, 263, 266; 451/523, 524, 525; 221/213, 312 R, 45; 601/136, 137, 138
See application file for complete search history.

(56) References Cited

U.S. PATENT DOCUMENTS

| | | | | | |
|---|---|---|---|---|---|
| 247,033 | A * | 9/1881 | Fisher | 118/201 |
| 2,168,179 | A * | 8/1939 | Edson | 401/202 |
| 2,223,096 | A * | 11/1940 | Daggett | 384/297 |
| 2,637,868 | A * | 5/1953 | Hamilton | 401/19 |
| 2,799,883 | A * | 7/1957 | Brady | 15/184 |
| 3,223,096 | A * | 12/1965 | Goldberg et al. | 15/104.94 |
| 3,912,665 | A * | 10/1975 | Spitzer et al. | 521/98 |
| 4,225,253 | A * | 9/1980 | Fraleigh | 401/9 |
| 4,884,913 | A * | 12/1989 | Smith et al. | 401/196 |
| 5,046,640 | A * | 9/1991 | Carroll | 221/213 |
| 6,174,099 | B1 * | 1/2001 | Patel et al. | 401/129 |
| 6,280,108 | B1 * | 8/2001 | Haining et al. | 401/6 |
| 6,523,717 | B1 * | 2/2003 | Willemsen | 221/267 |
| 6,629,983 | B1 * | 10/2003 | Ignon | 606/131 |
| 6,715,951 | B2 * | 4/2004 | Gueret | 401/130 |
| 6,991,527 | B2 * | 1/2006 | Linzell | 451/523 |
| 7,040,828 | B2 * | 5/2006 | LaPointe | 401/130 |
| 7,585,125 | B2 * | 9/2009 | Muhlhausen et al. | 401/125 |
| 7,610,647 | B2 * | 11/2009 | Morgan et al. | 15/104.94 |
| 2003/0049407 | A1 * | 3/2003 | Kacher et al. | 428/100 |

* cited by examiner

*Primary Examiner* — Lee D Wilson
*Assistant Examiner* — Joel Crandall
(74) *Attorney, Agent, or Firm* — Fox Rothschild LLP

(57) ABSTRACT

A rubbing pad-dispensing tool comprising a tubular body for holding by hand, the tubular body having an interior arranged for containing a stack of rubbing pads and a pad-dispensing orifice positioned on a first end thereof; the pad-dispensing orifice having an end cap closure therefor, and in which the exterior of the end cap closure is provided with a planar pad-carrying area arranged such that in use, the rubbing pads may be brought one at a time into carried contact therewith.

12 Claims, 4 Drawing Sheets

Figure 2A:
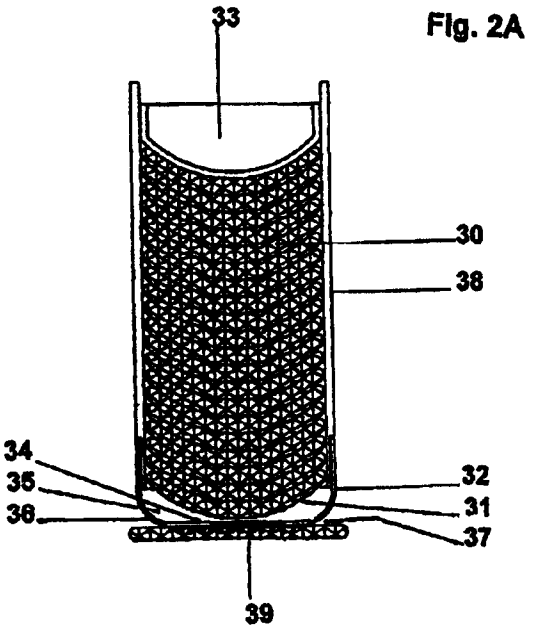

50
51
52
53
54
55
56
57
61
62
70
71
72
73
74
75
76
77
78
79
80
81
90
91
92
93
94
95

Fig. 8
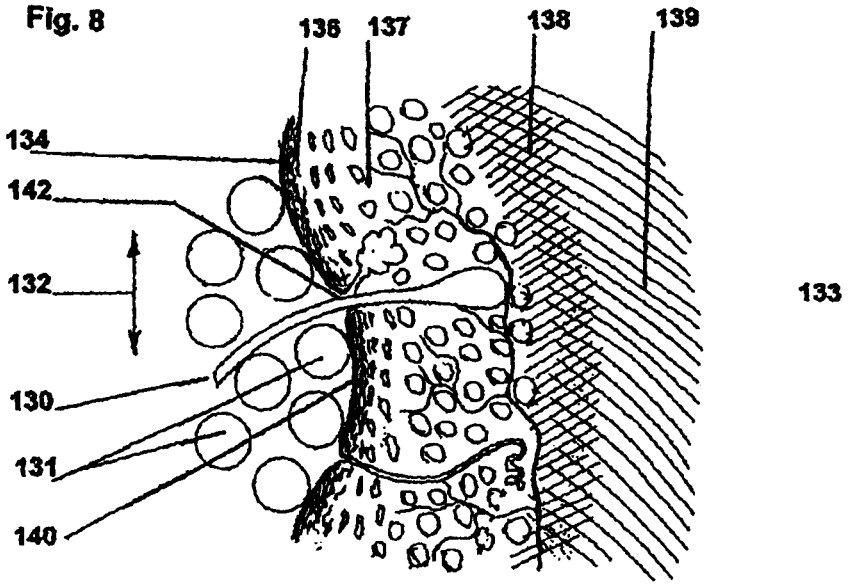
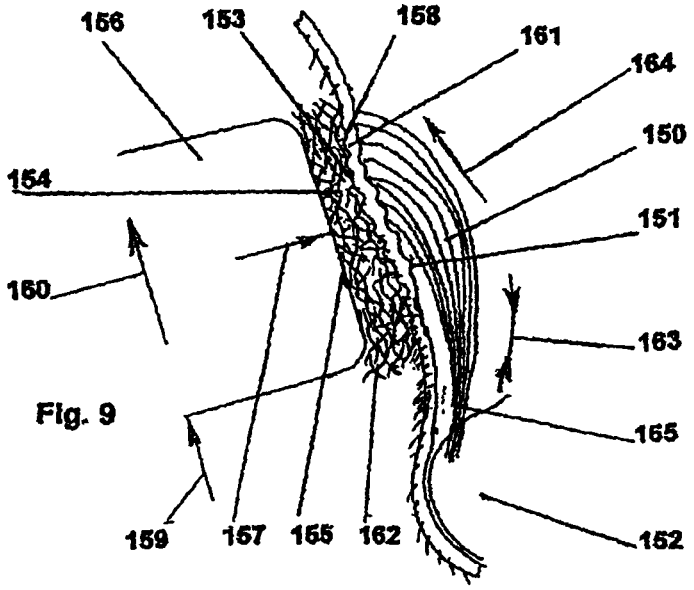
Fig. 9

PAD DISPENSING RUBBING TOOL

CROSS-REFERENCE

This application is a continuation of U.S. application Ser. No. 12/302,365, filed Nov. 25, 2008, which is the National Stage Application of PCT/GB07/001947, filed May 25, 2007, which claims priority to British Application No. 0610373.3, filed May 25, 2006; British Application No. 0619635.6, filed Oct. 5, 2006; and British Application No. 0702194.2, filed Feb. 6, 2007, the contents of which are incorporated by reference herein in their entirety.

FIELD OF INVENTION

There is described a rubbing tool for dispensing impregnated rubbing pads and means of use for treating surfaces.

BACKGROUND

Our U.S. Pat. No. 6,991,527 B2 discloses the construction of a rubbing tool that in one aspect resembles a deodorant stick, with a tubular housing containing a body of compressed lofty nonwoven mildly abrasive fibre, the fibre arranged either as a series of stacked pads or a roll of fibrous web, either optionally impregnated with chemical formulations. The pads were detachably attached to the stack and arranged normal to the axis of a tubular body so as to form layers, the end layer projecting from an orifice at one end, the first end, for rubbing against a surface. After rubbing the used pad is peeled off to expose a new surface, which is then positioned in the orifice ready for rubbing by indexing the stack along the tube, the indexing force applied to a slide-able platform located towards the second end of the stack. The platform slides inside the tube, conveniently done by coupling the platform with a propel/repel screw with its operating knob at the second end of the tool.

Originally the tool was designed for applying industrial chemicals to surfaces while rubbing, for example applying primers or friction modifying fluids onto metals. Other uses were found in cleaning, in particular removing stains from wood and soft furnishings. Further uses emerged in cleaning and treating ovenware. While the design has proved satisfactory for these uses, the underlying principle of storing and disposing of used layered pads has now been extended to improve these tools for domestic and car body cleaning and for use in other new areas, in particular the application of cosmetic lotions for skin care and shaving lubricants.

The improvement to the tool being the provision of means for transferring each pad, separately onto a functionally shaped pad carrying area on the outside of the tool case before rubbing, The pad carrying area is positioned on the removable closure and pads with new rubbing faces (friction faces) are transferred from inside the tubular body onto the outside of the closure without touching by hand, thus avoiding any risk of contamination of the pad or the users hands. Furthermore by selecting a suitably resilient pad material, its stiffness is usefully influenced over the rubbing face by shaping the pad carrying area so that it provides greater support (stiffness) in its central region, the support reducing progressively towards its edge, thereby providing a rubbing face with a soft edge, which soft edge minimises induced stresses associated with sliding the tool edge over a soft substrate such as soft furnishing, fabric, leather, skin or plant tissues. The soft edged rubbing pads reduce risk of injury during cosmetic procedures.

Finally, the step of removing the pad to be used for rubbing from the stack of unused pads and then resealing the storage cavity eliminates the risk of contamination of the new unused pads stored within the body during rubbing.

SUMMARY OF INVENTION

In one aspect a rubbing pad dispensing tool is provided, comprising a tubular body for holding by hand, said tubular body defining an interior arranged for containing a stack of rubbing pads therein and a pad dispensing orifice provided to a first end thereof; and provided to said pad dispensing orifice of the tubular body, an end cap closure therefor, wherein the exterior of the end cap closure is provided with a pad carrying area arranged such that in use, the rubbing pads may be brought one at a time into carried contact therewith.

DESCRIPTION OF INVENTION

The present invention provides a tool for rubbing surfaces with pads dispensed from within the tool, in which, a rubbing pad dispensing tool dispenses pads one at a time from within an integral sealed cavity. Each pad is transferred onto an outside surface of the tool before use; the transfer affected without touching the pad by hand. Therefore the invention provides hand holdable, and hand usable rubbing tool for treating surfaces by rubbing with a series of disposable pads.

The treating face of the tool is a friction face on a rubbing pad, the rubbing pad detachably attached to a pad carrying area. The pad made with frictional material is resilient and is supported on a shaped pad carrying area on the outside of the tool, the area shaped to provide progressively less support to the pad towards the pad edge. Therefore the invention provides a tool with a multiplicity of renewable rubbing faces, each new pad carrying a new face that has been stored in a dean sealed cavity prior to use.

A purpose of the tool is to frictionally treat a surface by rubbing and thereby apply mechanical energy to a surface preferably in the presence of a chemical substance to provide chemical mechanical effects while minimising induced shear stress in the treated surface, the shear stress minimised by making the edge of the supported pad soft. The chemical substance is conveniently delivered to the surface by Impregnating it into the rubbing pad.

Chemical mechanical interactions between the treating and the treated surface include the benefits of improved spreading and wetting, also the mechanical action provides energy to drive chemical interactions at molecular level between sliding surfaces. The mechanical action also provides means of displacing reaction by-products from the surface. If the treating surface of the pad is mildly abrasive it will provide an effective means of cleaning during rubbing, thereby providing the additional possibility of removing surface contamination and layers of dirt or oxide that may inhibit or impede chemical interaction between tool dispensed formulations and the surface being treated. In particular fibre pads in which the fibres are suitably spaced apart can advantageously carry mildly abrasive materials within a chemical formulation. Alternatively the abrasive materials can be bonded to the surface of the fibres or moulded into the fibres. A further advantage in the use of the tool is the application of friction to a surface that when the surface is soft and deformable, allows the surface to be deformed either systematically or randomly, again beneficially done in the presence of a chemical formulation. In particular the tools provided by the invention are suitable for applying chemical formulations to skin while applying massage.

Thus the uses for the tools described herein potentially range from applying chemical mechanical treatments onto hard surfaces such as metals, stone, plastics or glass for industrial purposes; or to affect chemical mechanical cleaning in domestic, institutional or car care environments; or to treat living tissue either biological (plant leaf for example) or mammalian skin for cosmetic purposes.

In aspects, the invention provides a tool with a tubular body for holding by hand, said tubular body defining an interior arranged for containing a stack of rubbing pads therein and a pad dispensing orifice provided to a first end thereof; and provided to said pad dispensing orifice of the tubular body, an end cap closure therefor, wherein the exterior of the end cap closure is provided with a pad carrying area arranged such that in use, the rubbing pads may be brought one at a time into carried contact therewith.

Thus, the tool comprises a tubular body sized for holding by hand, the body defining an interior, an enclosed space; a cavity with pads stored therein, stacked one upon another, the space defined by a tube with first and second ends. At its first end there is provided a removable sealing closure and towards its second end there is provided a platform that slides within the tubular body and with a sliding seal, thereby forming an adjustable sealed cavity.

The pads are shaped and sized to fit snugly inside the tubular profile (shape) so as to touch and be frictionally retained therein yet to be able to slide within the tube as an assembled multilayered stack when sufficient force Is applied to the sliding platform. The platform being in contact with the stack of stored pads has means of nudging the stack along the tube in the direction of the first end to position pads one at a time at an orifice covered by a closure. The means of nudging include the use of a propel repel screw mechanism or simply pushing with a finger against the frictional resistance of the pads sliding in the tube, which must be sufficient to maintain its position when the pad carrying area on the closure is pressed against the end pad to engage and remove it. A pad dispensing orifice is provided to a first end of the tubular body, and this orifice is sized and shaped to match the pads, arranged to position the leading edge of each pad level and parallel with the edge of the orifice prior to its removal from the stack.

The pads are placed one upon another within the stack without joining or binding together save for any slight entanglement of surface fibres or mutual attractive forces or adhesion due to any introduced fluid between or within the pads. The pads are stacked within the tubular body substantially parallel with the rubbing surface of the tool. The pads may be flat before stacking, or shaped as a shallow cup, which when pressed flat later provides a larger contact area.

The closure takes the form of an end cap with a projecting radial flange that fits over the end of the tubular body and engages with and provides a press fit protective seal therewith. Alternatively the flange may be threaded to fit a matching thread on the body, in which case matching sealable faces are included.

On the exterior of the end cap closure is provided a shaped region that acts as a pad carrying area arranged such that in use, the rubbing pads may be brought one at a time into carried contact therewith. The 'pad carrying area' thereon acts as a rubbing pad support surface and therefore forms an assembly comprising a rubbing pad and closure. The engaging faces between the pad and pad carrying area are shaped to provide a progressive engagement as the faces come together by making one or both faces domed. This allows the initial contact to be formed towards the centre and progressively spread outwards as the faces are pressed together. When the pad is domed (or cupped) and the pad is made of stretchable fibre web then the area of the pad friction face expands as it flattens in use to become greater than the cross section area of the tubular body and this is a preferred feature.

The central plateau region of the pad carrying area gains stiffness when domed. The pad carrying area is shaped to provide progressively less support to the rubbing pad towards its edges by the provision of a radius chamfer connecting the central plateau region with the closure flange.

When the removable closure is in place and sealing the tubular body, the 'pad carrying area' with pad attached projects away from the tubular body providing a hand holdable tool with a rubbing pad attached to one end.

There is provided on the 'pad carrying area' means for detachably attaching a rubbing pad, the means include an array of small protrusions shaped and sized to engage with and retain detachably attached rubbing pads in a position for rubbing. Upon completion of rubbing the pad is removed from the support area and disposed of. Pads are transferred from the cavity and positioned on the pad carrying area by the steps of 1). Removing and inverting the closure; 2). Pressing the pad carrying area on the support face against the pad positioned in the orifice to frictionally engage the pad with protrusions of the pad carrying area; 3). Withdrawing engaged pad and inverting closure and restoring it to its normal position sealing the tube—ready for use.

The central region of the pad carrying area resembles a plateau and is described hereinbefore as being 'domed' and this refers to the shape of the closure when viewed as a cross section viewed from the side (as illustrated later by reference to diagrams). The actual part of the closure referred to as the 'pad carrying area' includes part of a surrounding fillet and therefore has curved or arched features like a dome. The plateau region may be flat and therefore described as planar, the term planar means 'relating to or in the form of a plane', or domed, the term 'dome' means a body with 'ail its surfaces being curved'. Therefore a pad carrying area may have some planar and some dome like features the term planar is used herein to describe a substantially flat surface but not perfectly flat, and indeed both the domed and planar regions on a closure may deform slightly during rubbing if made with resiliently detonable materials. Thus what appears to be a domed shape initially might actually be closer to a flat shape during rubbing and after rubbing it then returns to substantially its original shape, although it may not return precisely to its original form depending upon its material properties.

Therefore the term 'domed' is used herein to describe the general shape in cross section of a closure end face that forms the pad carrying area, and includes a plateau region that can vary from a pronounced dome to a virtually flat surface. Therefore the actual dynamic shape of cross section of the pad carrying area can range from dome to a flat but is always surrounded by a fillet and the pad is larger than the central plateau region, therefore during rubbing the pad experiences progressively less support towards its edge due to the chamfer surrounding the support surface.

The tubular body itself, the sliding internal platform and the closure are preferably made as thermo plastic mouldings, made with any commonly available material, preferably polyolefin's, most preferably polypropylene or PET. It is typically injection moulded to a wall thickness between 1 mm and 2 mm.

In aspects, there is provided a pad dispensing tool wherein the pad carrying area on the end cap closure includes an array of protrusions projecting away from the plane defined thereby, the protrusions shaped to engage in a hook like manner with a rubbing pad upon contact therewith and provide equal retention in the x and y direction.

In aspects, a pad carrying area on a detachable closure on a dispensing tool is provided, wherein the protrusions are smooth and resiliently deformable and non aggressive against skin and spaced apart to facilitate cleaning. The actual protrusions may be an integral moulding, moulded with the closure during manufacture; or welded onto the closure later as a secondary operation; or attached to an intermediate body by adhesives, for example by use of a tape that is adhesively attached to the closure, the tape carrying the array of protrusions; such tapes being readily available under the name Vel-Loc, a registered name of Velcro Industries B.V. Curacao, NL. These tapes providing an array of small domed protrusions approximately as described hereinbefore.

In aspects, the protrusions on the pad carrying area of the detachable closure are positioned to progressively engage with a rubbing pad to allow the rubbing pad to expand as it is withdrawn from the tubular body. The aforementioned slightly domed support face enables those protrusions In the centre of the dome (the highest part) to make contact first and then progressively more protrusions come into contact as the support area is further pressed against the pad. After withdrawal and later upon pressing the transferred pad against the surface to be rubbed the transferred pad assumes the shape of the planar support face, which as explained herein before may not necessarily be flat.

In aspects, the protrusions on the pad carrying area of the detachable closure are retained by adhesives. The preferred adhesives being a contact adhesive In the form of tape strips.

In aspects, the detachable closure carries a pad carrying area with a radial chamfer (rounded) edges so that in use, one or more edges of a rubbing pad carried by the end cap closure project beyond the plateau region of the pad carrying area to provide soft edges thereto.

In aspects, the overhanging pad edge is finger grip-able to facilitate peeling off of a used pad after use.

In aspects, the pad carrying area on the end cap closure is domed.

In aspects, the pad carrying area approximately matches the shape of the rubbing pads to be attached thereto.

In aspects, the end cap closure has a cup shaped body with engaging flange, the flange defining the external shape at the base of the cup; and the pad carrying area is provided to said base of the cup. The intersection of the plateau area of the pad carrying face and the flange of the closure having a radial chamfer therebetween.

In aspects, the tubular body has provided to a second end thereof, a slide-able platform arranged to slide up within the tubular body for pushing a stack of rubbing pads towards the pad dispensing orifice of the tubular body, the sliding platform provided with a slide-able lip seal that maintains a seal during and after sliding, thereby protecting the stored pads at all time.

In aspects, in use each rubbing pad is positioned in turn at the pad dispensing orifice by indexing the slide-able platform.

In aspects, the tubular body defines a central axis that is normal to the plane defined by the pad carrying area. The pads arranged parallel with their edges aligned.

In aspects, the tubular body defines a central axis that is offset at an angle from normal to the plane defined by the pad carrying area. The pads arranged parallel with their edges offset to resemble a flight of steps.

In aspects, the tubular body defines a cross-section that is circular, elliptical, square or rectangular in form. The actual shape can vary widely and is determined largely by the use of the tool and the need to provide access to surfaces. For example when treating the human face, accessing the areas around the eyes and nose requires the friction face to narrow towards a point, whereas the treatment of the open areas of the face and neck requires a tool with significant length and breadth, thus a tool that narrows towards on end, perhaps resembling the shape of an arrow head is most suited for this application.

In aspects, a rubbing pad dispensing tool and rubbing pad assembly is provided comprising a rubbing pad dispensing tool according to the description hereinbefore; and a rubbing pad provided to the rubbing pad carrying area.

In aspects, a rubbing pad dispensing tool and rubbing pad assembly is provided additionally comprising a stack of rubbing pads provided to the interior of the tubular body. The rubbing pads individually comprising a resilient body with a friction face. The body and face of the pad may be of similar or dissimilar materials. For example the body may be a resilient foam, and the foam itself can in some cases be used as the friction face or the foam may be optionally covered with a fibre or friction inducing film like a thermo plastic elastomer.

In aspects, a rubbing pad dispensing tool and rubbing pad assembly is provided, wherein the rubbing pads comprise a fibrous material.

In aspects, rubbing pad dispensing tool and rubbing pad assembly is provided wherein the rubbing pads comprise a lofty nonwoven fibre web. The density of the spaced apart nonwoven fibre webs being in the range 10 to 120 kg·m3. A typically lofty low density non-woven web suitable for use as a friction pad is made with crinkled staple fibres of lengths of between 0.2 cm to 7 cm or with longer (virtually continuous) straight fibres, the fibres coupled by needle punch entanglement, adhesive or resin bonded, or thermal bonding by blending into the web a proportion of lower melting point fibres, which upon heating to the lower melting point these lower melt fibres selectively melt and bond the higher melt fibres together—these webs being typical of those used for skin contact use such as make-up removal, The physical characteristics of the friction pad and friction face can vary widely between applications. It is difficult to provide precise guidance on the most suitable density and stiffness of the friction pad material. As a guide for use on a male face, for applying shaving lubricant, a lofty non-woven web of resin bonded non-woven nylon or polypropylene with a density of 50 kg/m3 and web thickness of 5 mm made with a fibre of 10 micron diameter fibre was satisfactory. The web had a natural roughness of about 0.75 mm Ra. The web should have resilience so that it can engage with the facial stubble (hairs) and spring into and out of detents in skin roughness. A similar friction face for exfoliating and applying moisturiser or skin colouring dye to a female face or legs used 65 kg/m3 web, the web thickness being 2 mm and the fibre thickness was 7 micron. The web had a natural roughness of about 0.5 mm Ra. These webs often have one side more dense than the other, or they may have more bonding one side thus they may be stiffer on one side. Care is needed to specify which side is to be used as the friction face.

In aspects, a rubbing pad dispensing tool and rubbing pad assembly is provided, wherein each rubbing pad defines a rubbing face that is circular, elliptical, square or rectangular.

In aspects, a rubbing pad dispensing tool and rubbing pad assembly is provided, wherein the rubbing pads are formed into a cup shape and expand when later pressed flat In aspects, a method of preparing for use the rubbing pad dispensing tool according to any of claims 1 to 15, by removing the end cap closure from the tubular body, bringing said new rubbing pad into carrying contact with rubbing pad carrying area, taking a new rubbing pad from the stack, and restoring the end cap closure to its original position with the new rubbing pad in position for rubbing.

In aspects, method of use of the rubbing pad dispensing tool and rubbing pad assembly as described herein before, wherein the user grips the tubular body and brings the rubbing pad provided to the rubbing pad carrying area of the closure into rubbing contact with the skin.

In aspects, a method of use as described hereinbefore, wherein a chemical formulation is applied to the skin prior to, at the same time as, or subsequent to the rubbing contact with the skin.

In aspects, method of use as described hereinbefore wherein said chemical formulation is a shaving formulation.

In aspects, a method of use as described hereinbefore wherein said chemical formulation is a depilatory formulation.

Figure 1A:
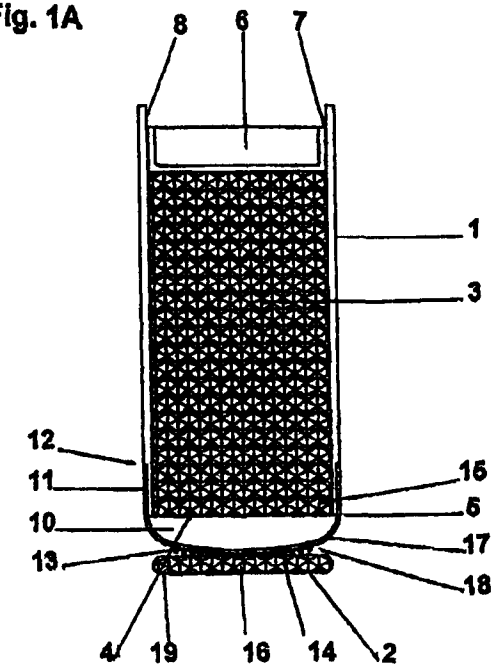

The invention is now described further by reference to the following Figures:

FIG. 1A—a cross-section view of an elliptical tool with a slightly domed head closure.

Figure 1B:
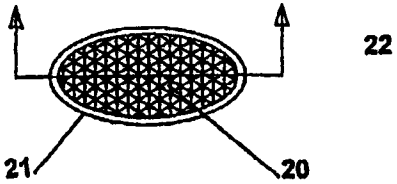

FIG. 1B—a plan view of the rubbing face of the tool in FIG. 1A.

FIG. 2A—a cross-section view of an elliptical tool with cupped fibre discs and a flat head closure.

Figure 2B:
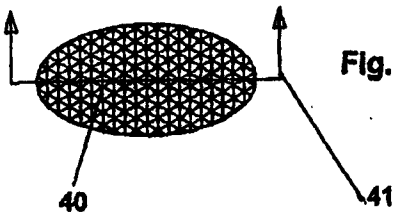

FIG. 2B—a plan view of the rubbing face of the tool of FIG. 2A showing a considerable expansion of the rubbing area once the cupped pad is flattened by pressing against the surface to be rubbed.

Figures 3A, 3B, 4A, 4B, 5:
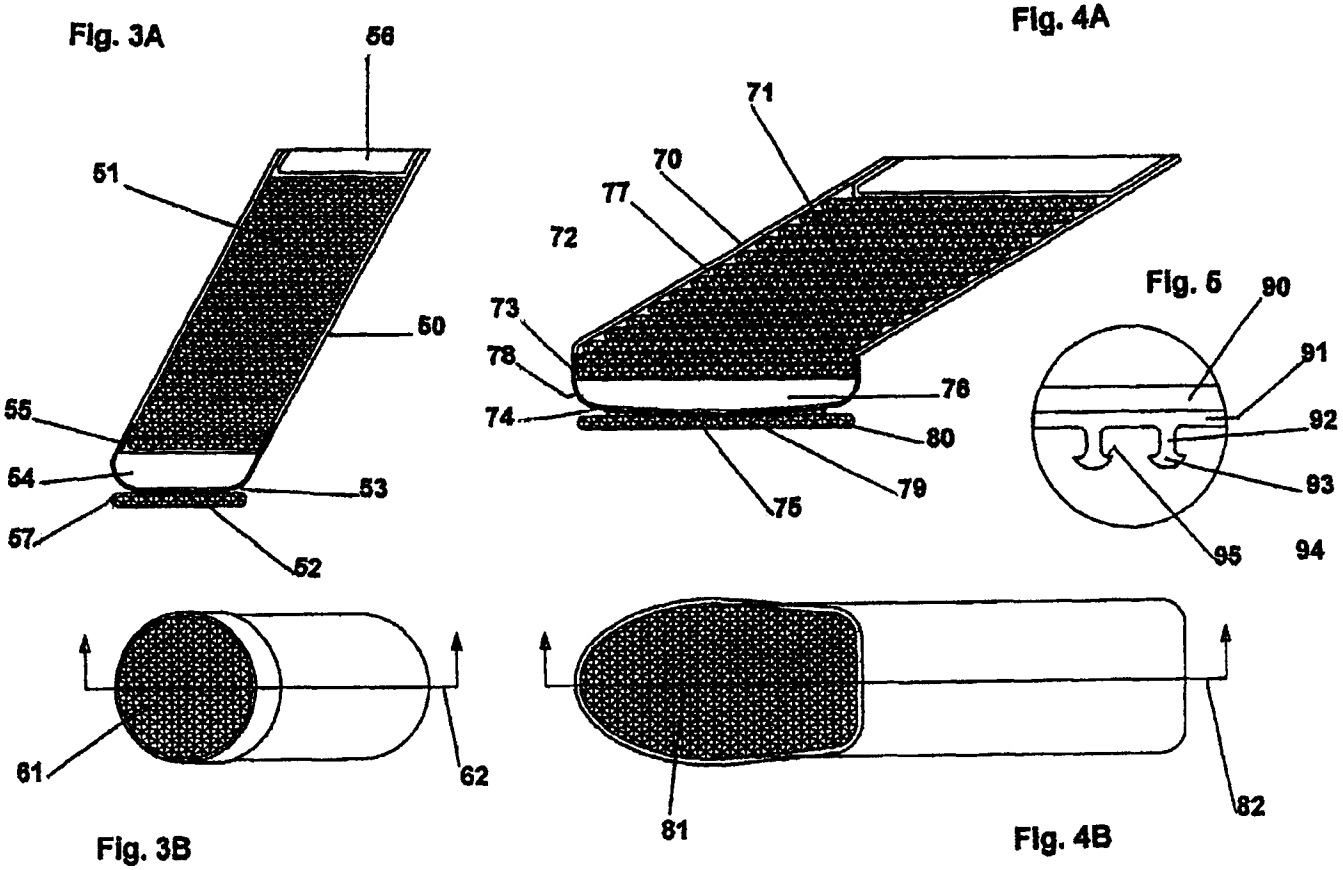

FIG. 3A a cross-section view of a circular bodied tool with pads stored at an angle to and with an angled flat face closure.

FIG. 3B—a plan view of the circular rubbing face on the tool of FIG. 3A.

FIG. 4A—a cross-section view of a more steeply angled tool body showing how the rubbing area of the pads is increased by laterally stacking pads of irregular shapes. This tool is shown with a slightly domed head to improve the stiffness of the support face.

FIG. 4B—a plan view of the irregular shaped face on the tool shown in FIG. 4A.

FIG. 5 shows a side view of the engagement protrusions expanded 10× for clarity.

Figure 6:
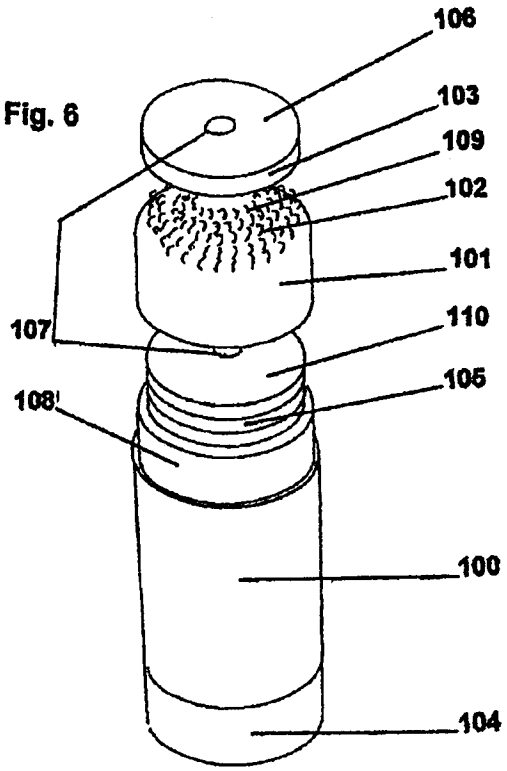

FIG. 6—shows a circular tool using pads with central holes to facilitate a feed screw running on the central axis of a propel/repel housing.

Figure 7:
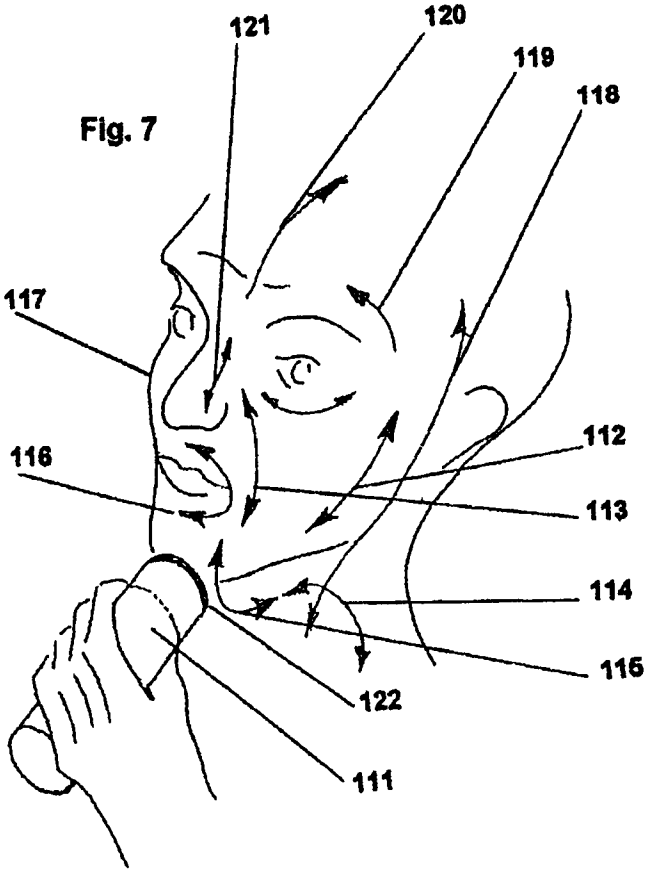

FIG. 7—Illustrates how the tool is used to apply shaving lubricant to a male face.

FIG. 8—a close up cross-section view showing interaction between fibres in a lofty nonwoven rubbing pad as they frictionally engage with facial hair and skin during rubbing.

FIG. 9—a cross section view of a facial muscle being exercised during the application of shaving lubricant with a tool carrying a lofty nonwoven pad.

FIG. 1A shows a cross section view of tubular tool body 1 this body is about 150 mm long, being similar in size to a propel/repel stick as typically used for applying gel deodorants. The tool body 1 is shown here with its axis positioned normal to (at right angles with) the plane of tool rubbing face 2. Within the tool body 1 is a stack 3 of twenty friction pads with significant thickness, typically 5 mm thick, and these pads being a lofty open structured nonwoven web. The first friction pad 4 is shown located in the orifice 5 of the tubular cavity. The last friction pad is backed by the slid-able platform 6, the sliding face 7 forming a sliding seal (lip seal) with the inside surface of the tubular body 8. The closure 10 is shown at 11 slid over and gripping up to the recess step 12 in the outer face of the tubular body 1 and forming a seal therewith. Thus the pads 3 are securely stored in a sealed cavity. In use the cupped closure 10 is slid off and inverted and pressed against the outer face of the end pad 4. There is an array of protrusions 13 attached to the outer face, the pad carrying area of the cupped closure 10, the protrusions 13 covering the central region of the pad carrying area on the closure 14. This pad carrying area provides support for the rubbing pad during rubbing. Upon pressing the pad support face 14 against face 4 the shaped protrusions penetrate the pad 15 and form mechanical interlocks therewith enabling the pad 15 to be withdrawn attached to the support face 14 on the closure 10. The closure 10 is then inverted and slid onto the tubular body 11 and 12 and pad 16 is ready for rubbing with rubbing face 2 thereon as shown. The support face 14 is shown slightly domed with a distinct chamfer radius at its edge 17 leaving a gap 18 where the pad is progressively less well supported, resulting in the tool having a soft edge 19.

FIG. 1B shows the end view of FIG. 1A viewed from the bottom. The rubbing face 20 is shown slightly smaller than the closure 21. The cross section axis is shown 22.

FIG. 2A shows a similar construction to FIG. 1A except for the shape of the pads and the support face. The pads 30 are cupped so as to nest one inside the other. The end pad 31 projects beyond the orifice 32. The sliding platform 33 is domed to fit the cupped pads 30. The closure 35 has a flat pad carrying area and support face 34 with radius chamfer at its edge 36. Upon removing the closure inverting and pressing the pad carrying area against face 31, protrusions at the centre of face 34 penetrate and mechanically couple with the central region of pad 31 and the pad is withdrawn. The closure 35 with a pad attached is inverted and slid back onto the main body 38. Upon pressing the rubbing face 39 against a flat surface 39 expands to give a larger area contact shown at 40 in FIG. 2B.

FIG. 2B shows the expanded area 40 of the pad 31. The pad area 40 shown larger than the closure 35. The cross section axis of FIG. 2A is shown at 41.

FIG. 3A shows a cross section view of a tool constructed as described in FIGS. 1A and B except the tubular body 50 is set at an angle to the rubbing face 52 and the profile of the tubular body 51 is shown flat and in FIG. 3B 61 as circular. The closure 54 flanges 55 are angled so as to form good sealing contacts and the flange depth must be made sufficient to stay securely in position during rubbing. The radius chamfer 53 around the edge of closure 54 provides less support at 53 for the rubbing pad, thereby providing a softer edge 57.

FIG. 3B shows the circular friction face 61 and the cross section 62 Intersection for FIG. 3A.

FIG. 4A is an example showing a more steeply angled main body 70 housing diagonally aligned pads 71 whose rubbing faces are parallel and the edges offset to form a step pattern 74 at the leading edge of the stack. It will be appreciated that by diagonally aligning the pads 71 the actual area of the rubbing pad is increased, but the number of pads (layers) that can be accommodated within a given volume is reduced. In this design it will be noted that the closure flanges 73 are actually aligned normal to the plane of the rubbing face 75, as are the last two pads to improve the stability of the closure 76 and pad 77 assembly during rubbing. Again, the pad support has a radius chamfer 78 around its edge leaving a gap 74 with less support thereby providing a tool with a pad 79 with soft edge 80.

FIG. 4B shows the actual pad shape 81 to be asymmetrical in one direction. The cross section intersection line is shown 82

It will be appreciated from the variations between examples on FIGS. 1, 2, 3 and 4. that generally the shape and size of the rubbing pads can be changed to suit application requirements without significantly changing the construction or operating principles of the tools. Also it will be noted that the support face can be made flat or domed and also the rubbing pads themselves can be made flat or cupped (inverted domes!).

FIG. 5 shows a scaled up (10 times magnification) of a cross section view of a protrusion that is suitable for use in an array on any previously described pad support face for engaging with lofty nonwoven web pads. There is shown a support face 90 on which is adhesively attached a base sheet 91 carrying stalks 92 with mushroom shaped heads 93, with smooth non-abrasive outer surfaces 94 and catching under faces 95. FIG. 6 illustrates a tool for implementing the method by applying a treatment such as for example a shaving lubricant in which a circular propel/repel container 100 is sized and shaped for gripping by hand, roughly 35 mm diameter and 100 mm long, in this tool the container closure 101 carries a pad support face 102 onto which the friction pad 103 that is impregnated with a shaving lubricant is attached.

The propel/repel moulding has a rotary knob 104 coupled to an internal screw (not shown) and upon turning 104 the stacked discs 105 stored within the tool body 100 are forced upwards. A column of pads 105, each of which in use serve as a friction pad, are made with an absorbent material such as foam, non-woven fibres In a form ranging from a thin paper wipe to a thick lofty non-woven polymeric web and each with friction faces 106 thereon. Each friction pad may have two faces that can be used as a friction faces and the density of these faces may differ to provide an optional soft or stiff friction face. Also the actual materials used in a column of pads (bodies) 105 stored within the same holder may be varied for purposes of delivering a graded treatment, perhaps starting with a soft friction face working up to a more aggressive face as the skin becomes accustomed to the process. These pads 105 are placed in the holder 100, usually laid one upon the other unsecured so as to be easily lifted off, but may optionally be interlinked with ties or adhesives run down the central screw hole 107, a hot melt adhesive was found to provide useful axial stiffening to the stack. Separators 108 made with plastic sheet may be placed between the bodies to prevent contamination filtering down or impregnated fluids settling out through the stacked column 105 during long periods of storage. The pad bodies may be stored dry or pre impregnated with a compound such as shaving lubricant, for example either a gel or soap. The closure 101 has means of attaching a friction pad, such means may be a contact adhesive or preferably an array of protrusions acting as hooks 109 that engage with loops of fibre within a body 103.

The method for using the tool is to unscrew (or slipping off if the closure flange is unthreaded) to remove the closure 101 from the body 100, turn knob 104 to expose a new friction pad 105 invert cap 101 and press the array of hooks 109 against the new friction pad 110 to engage it. Withdraw the closure 101 with new pad attached and screw back onto body 100. The tool may then be used as shown in example FIG. 7. When the rubbing pads 105 are not impregnated with shaving lubricant, it is either applied by dipping the tool with friction pad attached into a tub, or a shaving lubricant often in the form of a shaving gel is somehow dispensed onto the friction face from, for example a tube or aerosol container prior to use. For hygiene purposes ft is recommended that each friction pad is discarded after a single use, especially if the friction face is non-woven fibre.

FIG. 7, by way of an example, illustrates a method of use of the tool of FIG. 6 for applying shaving lotion to the lower face 110 by gripping the tool 111 and stroking in the directions of arrows 112, 113, 114, 115, 116. Further arrows 118, 119, 120 121 on the upper face illustrates how other cosmetic treatments may be extended to wet and exercise virtually all the facial muscles with similar tools.

The shaving lubricant is applied to the friction face 122 of a friction tool 111, which is then pressed against the lower face 110 and rubbed along the general alignment of the major muscles of the face 112, 113, 114, 115 in a reciprocating manner. The friction tool mechanically engages with the hairs as illustrated later herein in FIGS. 8 and 9 and pushes and pulls and thereby stretches and compresses the skin and the muscles attached thereto to exercise associated tissue and muscles. Friction tool 111 is here shown applying lubricant, such as shaving lather to the chin by sliding In the up/down direction shown by arrow 115. Arrow 112 shows the direction of sliding for the side bums. Arrow 113 shows the direction for treating the cheeks and 116 around the mouth. Arrow 114 shows the motion under the chin and down the neck. Because there are many overlaying minor expressive muscles around the lower part of the face, and these are orientated in various directions, this part of the face may be rubbed in more lateral directions with the tool 111 providing on average the direction of each stroke is reciprocated (alternated). Facial muscles generally benefit from rubbing exercise because they are mainly joined direct to the skin and can be seen bulging through the skin, therefore exercise influences face shape and improves facial appearance. The direction of rubbing should always be reciprocating so any plastic extension of the skin in one direction is cancelled by a reverse stroke in the opposite direction.

FIG. 8 illustrates a cross section view of skin with a single hair 130 and a typical follicle 133, the hair shown with a slightly downward inclination (sometimes called the nap or grain), which means it offers more resistance when engaging with the fibres 131 of the rubbing tool when moving in the upward direction in the diagram. In a lofty nonwoven web fibres 131 are oriented randomly and are spaced apart so hair 130 can penetrate between fibres 131 and at any point in time a number of fibres 131 randomly fictionally engage with facial hairs 130 during rubbing (sliding). The action of the friction fibres 131 rubbing the hair 130 is to deflect and bend the hair repeatedly as the direction of sliding alternates. The bending action opens up the keratin outer scales on the hair shaft and improves fluid absorption and therefore softens and lubricates the outer layers of the hair in preparation for shaving. The pumping action of the reciprocating horizontal fibres 131 drives fluid down into the hair shaft (follicle) 133 causing the hairs to further absorb and swell and stand up to improve razor access and reduce friction as they are shaved off.

Similar mechanical action applied with fibres 131 in a lofty nonwoven friction pad is highly advantageous in applying and accelerating the action of chemical depilatory formulations used to weaken disulfide bonds (not shown) in hair 130. These formulations typically employ calcium thioglycolate as their active ingredient, which unfortunately also attacks the keratin bonds in skin 134 if left on the skin much beyond 2 or 3 minutes. During rubbing with a friction pad attached to the tool, the chemical is dispensed from the pad onto the hair and penetrates the hair more rapidly and accelerates the chemical action, and weakening the hair by repeated bending and tugging, especially where it emerges from the folical 142. Furthermore as the hair weakens it may be scraped off with the same fibres within the same or a similar fibres within a similar friction pad as used to apply the chemical. The pad can also be advantageously used to dispense a rinse that deactivates and removes remaining chemical from the skin while scraping. The mechanical acceleration of the chemical action permits lower strength formulations to be used and this reduces the risk of skin irritation. If the same pad is used to remove hair 130 then the rinse can be affected by simply dipping the end of the tool with the pad attached into clean warm water, and continuing to rub, the closure seal prevents water entering and contaminating stored new pads. Clean water increases the friction between hair and the tool to accelerate removal.

FIG. 8 also shows a simplified cross section view of the primary layers of mammalian skin. The diagram also illustrates the cutaneous layers 136, 137 and subcutaneous layers 138 139. Due to the effects of rubbing with a friction pad, these layers are subjected to beneficial mechanical exercise during preparation for shaving when using a friction face fibrous tool as described hereinbefore. Friction face fibres 131 are shown pressing against face 134, this deforms the skin inwards at 140 to form an interlock that resists lateral sliding independent of the hair. The hair 130 Is shown surrounded by fibres 131 so the hair also resists sliding. Finally, there will be molecular attractions between the tool and skin and these attractions also resist sliding. Each of these friction sources contributes towards a cosmetic improvement in the appearance of skin after rubbing.

It should be noted that the root of the hair 130 penetrates virtually right through the dermal layers 136 and 137, which are the epidermis 136 the outer water proof layer that covers the tough leathery dermis 137. Therefore friction forces pulling on the hair shaft 130 during rubbing are transmitted into the subcutaneous layers 138 and 139 and therefore the friction effects on the hairs also usefully exercise these subcutaneous layers—the hyperdermis 138 and underlying connective tissue and muscle 139.

FIG. 9 shows, in a simplified cross section view through skin tissues, how the tool is beneficially used to exercise facial muscles, for example during the application of shaving lubricant A schematic single muscle 150 is shown linking between the underface of the skin—the hypodermis 151 to a bone 152. The diagram shows a tool body 156 carrying friction face 153 on a friction pad 154, in turn supported by support face 155. The friction pad 154 with friction face 153 thereon is pressed against skin in direction of arrow 157 to form a frictional engagement at interface 158. An external lateral force 159 is then applied to slide the friction face in the direction of arrow 160 that is parallel (lateral) with the skin to slide the tool against the skin.

The frictional interface 158 is shown wavy to represent the rough face of the friction face 153 deforming the skin 161 and thereby forming many wavy high friction interlocks between the friction face 153 and deforming skin and hairs 161. Friction pad 154 extends beyond the support 155 at the edge 162 providing a soft edge to minimise stress transitions in the skin during sliding.

The muscle 150 is in compression (internally tensed) in the direction of arrows 163. An external tensile stress is applied by the sliding motion of friction face 153 in direction 164 (which alternates), which stretches the muscle 150 in the direction of arrow 164. The stretching exercises the muscle, reacting via the tendon 165 that is firmly anchored to the bone 152, this is known as resistance exercise. By routinely exercising facial muscles in this way either during the application of shaving lubricant with the tool, facial muscles are beneficially exercised and the face shape is improved as a result.

The invention claimed is:

1. A rubbing pad dispensing tool comprising:

(A) an elongated tubular body:

(i) which can be held by the hand of an individual;

(ii) which has an interior cavity that has a first end and a second end, that has an inside surface and that includes a space which is capable of containing a stack of a plurality of rubbing pads; and (iii) which has an orifice at each end of the cavity, the structure of which is capable of accommodating the entire stack of pads, (a) the orifice at the first end of the cavity constituting an opening through which a pad can be removed from the cavity and (b) the orifice at the second end of the cavity capable of being closed with a removable, slidable platform having a to surface for supporting the rubbing pad at the bottom of the stack;

(B) said space extending between said orifices and defined by said inside surface of the cavity and sized such that rubbing pads contained therein are frictionally and slidably retained in the space;

(C) a removable end cap closure which seals said orifice at the first end of said cavity, but which, upon being removed from the body by an individual, provides access to the cavity, said end cap closure having an exterior surface;

(D) a planar pad-carrying area which is positioned on the exterior surface of the end cap closure and which end cap closure has protrusions for detachably attaching thereto a pad; and (E) a slidable platform within the cavity being capable of being pushed against said rubbing pad at the bottom of the stack to move the stack upwardly towards the pad-removable orifice.

2. A tool according to claim 1 in which the protrusions include an array of protrusions shaped to engage in a hook-like manner a pad.

3. A tool according to claim 2 in which the protrusions are smooth and resiliently deformable and non-aggressive against skin and spaced apart to facilitate cleaning.

4. A tool according to claim 1 in which the end cap closure is domed.

5. A tool according to claim 1 in which the end cap closure has a cup-shaped body with engaging flange, the flange defining the external shape at the base of the cup-shaped body; and the pad-carrying area is provided to said base of the cup-shaped body.

6. A rubbing pad dispensing tool comprising:

(A) an elongated tubular body:

(i) which can be held by the hand of an individual;

(ii) which has an interior cavity that has a first and second end, that has an inside surface that includes a space containing a slidable stack of a plurality of rubbing pads that are frictionally retained therein by the inside surface of the cavity, including (a) an end pad at one end of the stack and a top pad at the other end of the stack and (iii) which has an orifice at each end of the cavity, the structure of which is capable of accommodating the entire stack of pads, (a) the orifice at the first end of the cavity constituting an opening through which the end pad can be removed from the cavity; and (b) the orifice at the second end of the cavity being closed with a removable, slidable platform having a to surface for supporting the rubbing pad at the bottom of the stack;

(B) said space extending between said orifices and defined by said inside surface of the cavity and sized such that rubbing pads contained therein are frictionally and slidably retained in the space;

(C) a removable end cap closure which seals said orifice at the first end of said cavity, but which, upon being removed from the body by an individual, provides access to the end pad, said end cap closure having an exterior surface; and (D) a planar pad-carrying area which is positioned on the exterior surface of the end cap closure and which end cap closure has protrusions for detachably attaching thereto a pad; and (E) said slidable platform capable to being pushed against said rubbing pad at the bottom of the stack to move the stack upwardly towards the pad-removable orifice.

7. A tool according to claim 6 in which the protrusions include an array of protrusions shaped to engage in a hook-like manner the end pad.

8. A method for preparing for use a rubbing pad assembly tool comprising:

(A) an elongated tubular body:

(i) which can be held by the hand of an individual;

(ii) which has an interior cavity that has a first and second end, that has an inside surface that includes a space containing a slidable stack of a plurality of rubbing pads that are frictionally retained therein by the inside surface of the cavity, including an end pad at one end of the stack and a to pad at the other end of the stack; and (iii) which has an orifice at each end of the cavity, the structure of which is capable of accommodating the entire stack of pads, (a) the orifice at the first end of the cavity constituting an opening through which the end pad can be removed from the cavity; and (b) the orifice at the second end of the cavity being closed with a removable, slidable platform having a top surface for supporting the rubbing pad at the bottom of the stack;

(B) said space extending between said orifices and defined by said inside surface of the cavity and sized such that rubbing pads contained therein are frictionally and slidably retained in the space;

(C) a removable end cap closure which seals said orifice at the first end of said cavity, but which, upon being removed from the body by an individual, provides access to the end pad, said end cap closure having an exterior surface; and (D) a planar pad-carrying area which is positioned on the exterior surface of the end cap closure and which end cap closure has protrusions for detachably attaching thereto a pad; and (E) said slidable platform capable to being pushed against said rubbing pad at the bottom of the stack to move the stack upwardly towards the pad-removable orifice, the method including removal of the end cap closure from the tubular body to provide access to the end pad, contacting the end pad with the area's exterior surface to engage the end pad, and withdrawing the end pad from the cavity with the or exterior surface of the end cap.

9. A method according to claim 8 wherein the pad is brought into rubbing contact with the skin of an individual.

10. A method of use according to claim 9, wherein a chemical formulation is applied to the skin prior to, at the same time as, or subsequent to the rubbing contact with the skin.

11. A method according to claim 10 wherein the chemical formulation is a shaving lubricant that is applied to the skin prior to rubbing contact with the skin.

12. A method according to claim 9 in which the withdrawn pad contains a chemical formulation which is applied to the skin upon rubbing contact with the skin.

* * * * *